US007716853B2

(12) United States Patent
Finnegan

(10) Patent No.: US 7,716,853 B2
(45) Date of Patent: May 18, 2010

(54) SUCTION FITTED BOOT

(76) Inventor: Neil Finnegan, 103 Kororoit Creek Road, Williamstown, Victoria 3016 (AU)

( * ) Notice: Subject to any disclaimer, the term of this patent is extended or adjusted under 35 U.S.C. 154(b) by 767 days.

(21) Appl. No.: 11/596,951

(22) PCT Filed: May 12, 2005

(86) PCT No.: PCT/AU2005/000665

§ 371 (c)(1),
(2), (4) Date: Nov. 17, 2006

(87) PCT Pub. No.: WO2005/112679

PCT Pub. Date: Dec. 1, 2005

(65) Prior Publication Data

US 2008/0028493 A1 Feb. 7, 2008

(30) Foreign Application Priority Data

May 21, 2004 (AU) ..... 2004902744

(51) Int. Cl.
*A43B 5/08* (2006.01)

(52) U.S. Cl. ..... 36/8.1; 36/3 B; 36/3 R

(58) Field of Classification Search ..... 36/8.1, 36/3 B, 3 R, 116, 3 A; 441/61–64
See application file for complete search history.

(56) References Cited

U.S. PATENT DOCUMENTS

| | | | | | |
|---|---|---|---|---|---|
| 4,995,173 | A * | 2/1991 | Spier | 36/29 |
| 5,068,981 | A * | 12/1991 | Jung | 36/3 R |
| 5,477,626 | A * | 12/1995 | Kwon | 36/3 B |
| 5,564,201 | A * | 10/1996 | O'Connell | 36/3 R |
| 5,727,338 | A * | 3/1998 | George et al. | 36/93 |
| 6,122,844 | A * | 9/2000 | Nunez | 36/29 |
| 6,247,248 | B1 * | 6/2001 | Clark | 36/3 B |
| 2004/0163278 | A1 * | 8/2004 | Caspers et al. | 36/3 R |
| 2008/0052967 | A1 * | 3/2008 | Fu | 36/3 B |

* cited by examiner

*Primary Examiner*—Ted Kavanaugh
(74) *Attorney, Agent, or Firm*—Defillo & Associates, Inc; Evelyn A. Defillo

(57) ABSTRACT

A suction fitted garment is disclosed. There is provided a garment for water-related activities, said garment including a body shaped to fit a wearer and a pump mounted to the body for operation out of water and underwater to remove the air and water trapped between the body and the wearer and to generate a vacuum between the body and the wearer. Generating a vacuum between the body and the wearer provides a close fit to the wearer, whereby said close fit enhances the wearer's tactile sensitivity through the body.

6 Claims, 2 Drawing Sheets

SUCTION FITTED BOOT

CROSS REFERENCE TO RELATED APPLICATION

This application is a national stage of PCT/AU2005/000665 filed May 12, 2005 and based upon Australian Application No. AU2004902744 filed May 21, 2004, under the International Convention.

FIELD OF THE INVENTION

This invention relates to garments and particularly to flexible garments. The invention specifically relates to garments for water-related activities. The invention has particular application to booties, but can be applied to other garments and uses.

BACKGROUND OF THE INVENTION

Wetsuits and booties are typically used by water-goers when engaging in water-related activities, such a scuba diving, snorkeling, surfing, sailing, kite surfing, surf skiing, wind surfing, canoeing, kayaking, jet skiing or any other application where wet-quits, and the like are used.

In the course of these activities, but particularly with surfing, air and water becomes trapped between the wet-quit, booties, or other similar such garments and the wearer's body. While the trapped air and water provides an insulative layer due to being heated by the wearer's body heat, the trapped air and water separate the wearer's body from the wet-quit, bootie or other similar such garment.

In this manner the trapped air and water act as a cushion to diminish the wearer's tactile sensitivity through the wet-quit, bootie or other similar such garment. This reduced sensitivity deprives the wearer of information, or feel, which would otherwise be available if the wet-quit, bootie or other similar such garment were closely fitted to the wearer. In surfing, for example, the cushioning effect may reduce a surfer's information feedback from their surfboard on the board handling and wave conditions and ability to balance and move on and around the surfboard.

In relation to the close fitting of snow ski boots to a wearer's feet to improve feel while snow skiing, U.S. Pat. No. 5,727,338, to George et. al, uses pumps to evacuate air from a rigid ski boot and to generate a vacuum within the boot such that the soft boot liner fits closely to the wearer's foot. Similar vacuum fitting boots are disclosed in U.S. Pat. No. 4,702,022 and U.S. Pat. No. 4,654,986.

Reference to any prior art in the specification is not, and should not be taken as, an acknowledgement or any form of suggestion that this prior art forms any part of the common general knowledge in Australia or any other jurisdiction.

In view of the above, it is an object of the invention to provide a garment having improved tactile sensitivity.

SUMMARY OF THE INVENTION

In accordance with the invention, there is provided a garment for water-related activities, said garment including a body shaped to fit a wearer and a pump mounted to the body for operation out of water and underwater to remove the air and water trapped between the body and the wearer and to generate a vacuum between the body and the wearer. Generating a vacuum between the body and the wearer provides a close fit to the wearer, whereby said close fit enhances the wearer's tactile sensitivity through the body.

It will be appreciated that the vacuum causes the whole garment to closely fit to the wearer such that the exterior of the garment conforms to the shape of the wearer's body part to which the garment is fitted.

In the preferred embodiment, the garment is formed of a flexible material, such as neoprene or similar such material, and can be a bootie, but may otherwise be a wetsuit or similar such garment or part thereof. The pump is preferably formed or mounted on the bootie or similar such garment for manual operation by a wearer, but may be formed as a cavity or chamber in the body or in or on a surface of the bootie or similar such garment.

In the case of a bootie, it is preferable for booties formed according to the invention to have the pump located on the heel of the wearer's foot for actuation by the user's hand, opposite foot, or by forcing the pump against a fixed object, such as a foot strap or the deck of a sail boat, sail board or other surface. in such location, it is preferred that the garment includes a conduit for conveying air and water inside the bootie from the toe area to the pump. While such location of the pump and conduit is preferable, Other locations may be used. For instance the conduit may be formed to collect water from a number of different positions within the bootie or garment where water collects. For example this could be either side of the arch of the bootie, the heel as well as the toe area. The conduit preferably includes a filter that prevents water-entrained sand and grit from entering the pump. Where a conduit is not used a filter would preferably still be included for the pump to prevent water-entrained sand and grit from entering the pump.

BRIEF DESCRIPTION OF THE DRAWINGS

A preferred embodiment of the invention will now be described, by way of example only, with reference to the accompanying drawings.

DETAILED DESCRIPTION OF THE PREFERRED EMBODIMENT

Figure 1:
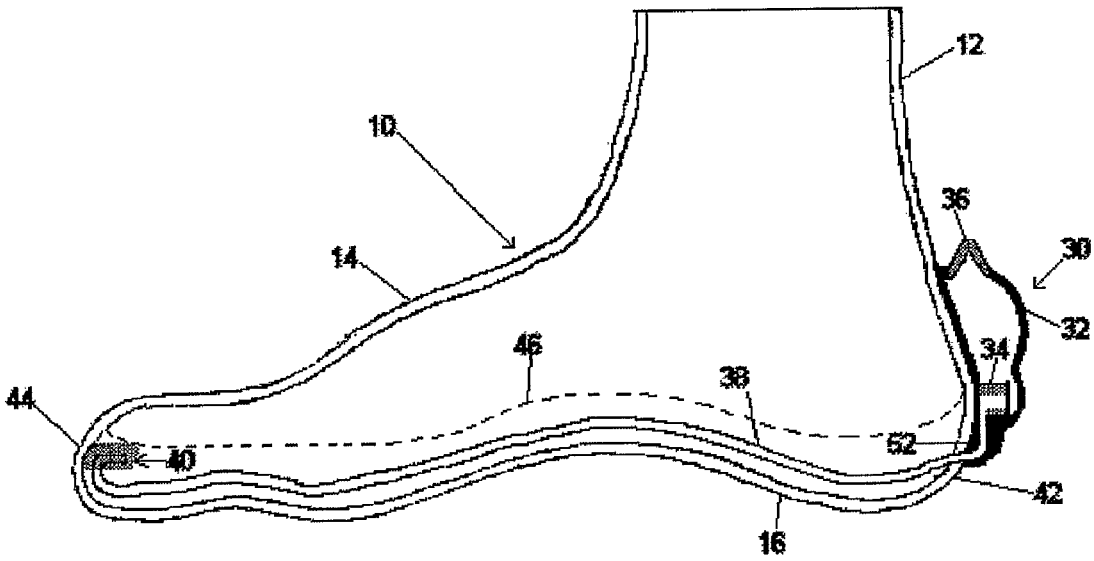
FIG. 1 shows a cross section of a bootie in accordance with the invention.

Referring to FIG. 1, a garment according to a preferred embodiment of the invention is shown as wetsuit bootie 10. The bootie 10 comprises a body 12 and a pump 30 for removing air and water trapped between the body 12 and the foot of a wearer and to generate a vacuum between the body 12 and the wearers foot such that the body 12 fits closely to the wearer's foot.

The body 12 includes a sole 16, upper 14 and heel 42 on which is mounted the pump 30. Mounted in this location, the pump 30 does not restrict ankle movement and does not interfere with a full length wetsuit or an ankle rope for a surf board.

The pump 30 comprises of a resilient bladder 32 formed as a hollow dome from a suitable rubber or similar material. The bladder 32 is preferably formed from a soft rubberized material to provide the bladder 32 with resiliency and to ensure that the bladder 32 does not cause injury to the wearer or other people or damage to the wearer's surf board or other equipment. Although the bladder 32 here is shown as a dome, the bladder 32 may be formed in other shapes to minimise drag in the water. The pump 30 further includes one-way valves or similar devices 34, which respectively communicate air and water from the interior of the bootie 10 to the bladder 32 and from the bladder 32 to the outside environment. The one-way valves 34, 36 are formed of non-corrosive materials so they can withstand use over a prolonged period in salt-water. The one way valves 34, 36 are preferably slit valves or other suitable system that allow the passing of sand and grit that has entered and are shaped to minimise drag in the water.

A conduit 38 is provided in the form of tube. The conduit 38 preferably extends around the bootie 10 to terminate inside the bootie 10 at the toe area 44, such that the pump 30 operates to remove water from the lower portions of the bootie 10 where the water collects under the influence of gravity. The conduit enters the pump at the pump inlet 52. The conduit 38 tube is preferably concealed within the outside folds 46 of the sole 16 of the bootie as they wrap around the upper 14 of the bootie. The conduit 38 is preferably made from a soft, flexible, tubing material that won't crimp and can retain its shape if bent, such as PVC, silicon or other similar such materials. Alternatively, the conduit may take the form of groves or channels etched into, moulded or formed by other means within the form of the! bootie 10.

A filter 40 is provided and fitted to the free end of the conduit 38. The filter 40 is adapted to prevent sand and grit entering the conduit 38 and blocking the one-way valves 34. The filter 40 is a porous fabric or other material that allows air and water to pass and prevent sand and grit from passing. The inner lining of a bootie could also be used as the filter 40. The filter preferably encloses the free end or ends of the conduit to the wall of the bootie 10, covering an area where the I conduit end enters the inside of the bootie 10. A soft fabric material used for filter will also act as a cushion for the wearer from the edges of the conduit 38 within the bootie 10. Where the inner lining of the bootie is used as the filter 40, then the conduit end would terminate at the inner lining of the bootie 10 and no additional material would be required for the filter 40. The filter 40 may also be adapted directly to the pump where no conduit is used.

The pump 30 can be operated by deforming the bladder 32 to reduce its volume.

In reducing the volume of the bladder 32, the pressure inside the bladder 32 increases and the one-way valve 34 remains closed but the one-way valve 36 opens due to the increased pressure. Consequently air and water held within the bladder 32 are expelled through the valve 36 to the outside environment. This is one method of operation. The patent is to cover this and also any other method of i operation.

After being deformed, the bladder 32 will revert to its domed shape. In doing so, the pressure inside the bladder becomes less than the pressure inside the bootie so the valve 36 closes and the valve 34 opens and thereby sucks air and water out of the bootie 10. Once the bladder 32 has returned to its domed shape, it may be deformed again to expel the air and water held within the bladder 32 via the one-way valve 36.

Repeated pumping of the bladder 32 removes air and water from within the bootie and, in part, improves the fitting of the body 12 to the wearer's foot. The bladder 32 may, however, be pumped to an extent such that a vacuum is created within the bootie 10 which ensures that the body 12 closely fits about the wearers foot and thus ensures that tactile sensitivity through the bootie 10 is optimised.

Figure 2:
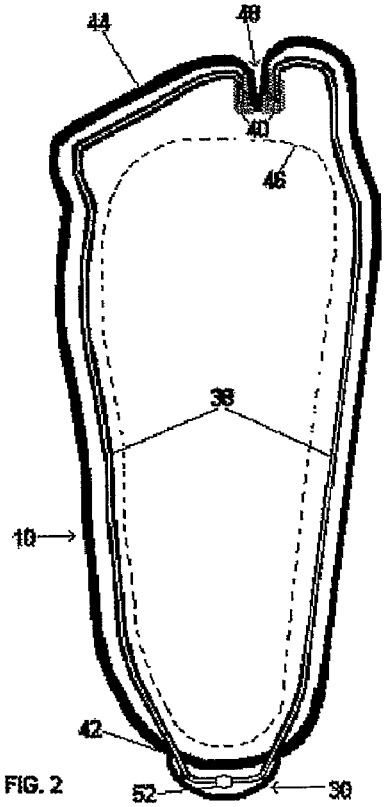
FIG. 2 shows the adaptation of the invention to a split toe bootie.

FIG. 2 shows a variation of the bootie in the form of a split toe bootie, where it's preferable for the conduit 38 to be formed as a branch leading from the points where water collects. In the case of FIG. 2, the preferable points where the branched conduit ends are either side of the split toe 48, where water will collect when the bootie 10 is pointed in a downwards direction. In FIG. 2 both branches of the conduit 38 lead into the pump inlet 52 within the pump 30. The conduit 38 can be branched to a number of points, within a bootie or similar such garment, to optimise removing air and water within the bootie or similar such garment.

Figure 3:
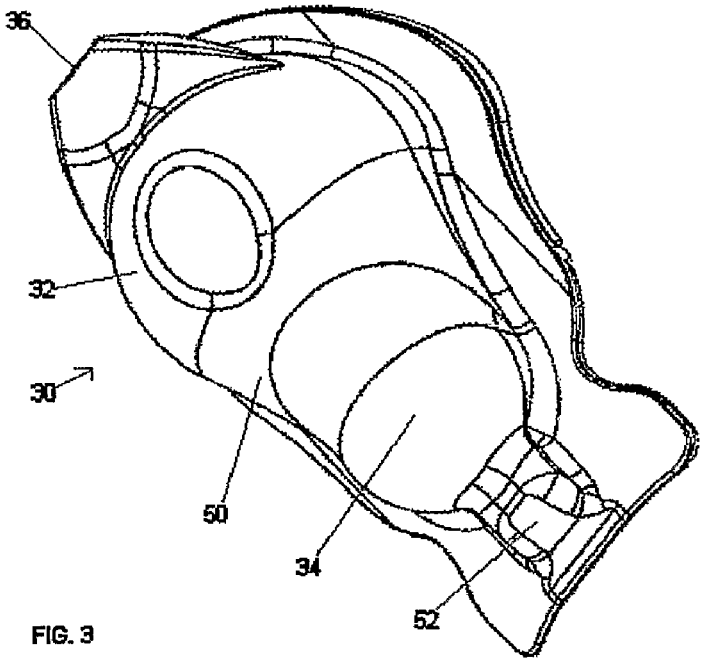
FIG. 3 and FIG. 4 show the preferred embodiment of the pump for this invention.

FIG. 3 shows the outer casing 50 of the preferred embodiment of the pump 30, including the casing section for the pump inlet 52, the casing section for the internal one way valve 34, the bladder 32 and the external one way valve 36.

Figure 4:
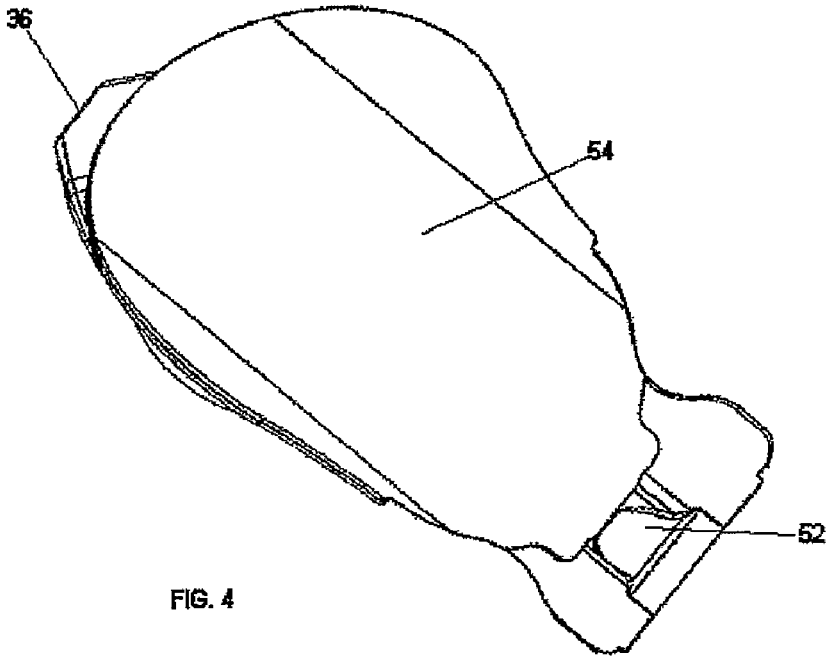

FIG. 4 show the inner casing 54 of the preferred embodiment of the pump 30, which is moulded to the shape of the heel 42 of the bootie 10, including the pump inlet 52.

In an alternative embodiment of the pump 30 may include a small electric pump that is powered by battery, solar or other such power source. The electric pump and power source may be located externally on the garment or bootie 10 or located within the body 12 of the bootie or garment. The electric pump may further include the conduit and filter 40 mentioned above, respectively, for retrieving water from a number of different locations where the water collects within the garment or bootie 10 and for preventing sand and grit entering the conduit and obstructing the electric pump.

The claims defining the invention are as follows:

1. A suction fitted garment for water-related activities, said garment comprising:

a flexible outer body shaped to fit a portion of the body of the wearer;

a pump mounted to the flexible outer body to remove air and water trapped between the flexible outer body and the portion of the outer body of the wearer and to generate a vacuum;

a conduit connected to the underwater pump and extending through the length of the flexible outer body, wherein the conduit conveys air and water inside the garment from a number of different positions;

wherein the vacuum causes the flexible outer body to closely fit to the wearer's body part to which the garment is fitted; and wherein the flexible outer body is made of a flexible waterproof material.

2. The suction fitted garment of claim 1, wherein the garment further includes a filter that prevents water-entrained sand from entering the pump.

3. The suction fitted garment of claim 1, wherein the pump is mounted on or within the flexible outer body of the garment for manual operation by a wearer.

4. The suction fitted garment claim 1, wherein the pump is formed as a cavity or chamber in the flexible outer body in a surface of the garment.

5. The suction fitted garment of claim 1, wherein the garment is made of neoprene.

6. The suction fitted garment of claim 5, wherein the garment is a bootie.

* * * * *